US010428832B2

(12) United States Patent
Lockhart et al.

(10) Patent No.: US 10,428,832 B2
(45) Date of Patent: Oct. 1, 2019

(54) STATOR ANTI-ROTATION LUG

(75) Inventors: Eugene Lockhart, North Berwick, ME (US); Jess A. Weinstein, Portland, ME (US); David P. Dube, Saco, ME (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 2052 days.

(21) Appl. No.: 13/567,376

(22) Filed: Aug. 6, 2012

(65) Prior Publication Data

US 2014/0033734 A1 Feb. 6, 2014

(51) Int. Cl.

| | |
|---|---|
| ***F04D 29/54*** | (2006.01) |
| ***F04D 29/64*** | (2006.01) |
| ***F01D 9/04*** | (2006.01) |

(52) U.S. Cl.

CPC ..... *F04D 29/542* (2013.01); *F01D 9/042* (2013.01); *F04D 29/644* (2013.01); *F05D 2220/3216* (2013.01); *F05D 2230/642* (2013.01); *F05D 2260/36* (2013.01); *Y10T 29/49245* (2015.01)

(58) Field of Classification Search

CPC ..... F04D 29/542; F04D 29/644; F01D 9/042; F01D 5/323

See application file for complete search history.

(56) References Cited

U.S. PATENT DOCUMENTS 3,112,916 A * 12/1963 Miller, Jr. et al. ..... 416/220 R
4,389,051 A 6/1983 Mullaney
4,522,559 A * 6/1985 Burge ..... F01D 25/26 415/138
4,632,634 A 12/1986 Vinciguerra et al.
5,004,402 A 4/1991 Burchette et al.
5,127,797 A 7/1992 Carman
5,653,581 A 8/1997 Dixon et al.
6,537,022 B1 5/2003 Housley et al.
6,585,479 B2 7/2003 Torrance
6,863,497 B2 3/2005 Seydel et al.
7,032,904 B2 4/2006 Rogers
7,144,218 B2 12/2006 Dube et al.
(Continued)

FOREIGN PATENT DOCUMENTS

GB 856599 12/1960
GB 2309053 7/1997

OTHER PUBLICATIONS

International Search Report and Written Opinion for PCT Application No. PCT/US2013/051562 dated Oct. 7, 2013.
(Continued)

*Primary Examiner* — Justin D Seabe
*Assistant Examiner* — Jason A Fountain
(74) *Attorney, Agent, or Firm* — Carlson, Gaskey & Olds, P.C.

(57) ABSTRACT

A compressor assembly of a gas turbine engine includes a case including at least one opening and a stator assembly supported within the case. A lug assembly is secured to the case and sets a position of the stator assembly relative to the case. The lug assembly includes a lug engaging the stator assembly and a boss extending from the lug through the opening in the case. The boss including a threaded hole receiving a threaded member holding the lug assembly to the case and defines a seat for the threaded member that is spaced apart from an outer surface of the case.

18 Claims, 4 Drawing Sheets

(56) References Cited

U.S. PATENT DOCUMENTS

| | | | | |
|---|---|---|---|---|
| 7,296,957 | B2 * | 11/2007 | Walter | F16B 33/002 411/113 |
| 8,128,021 | B2 * | 3/2012 | Suciu et al. | 244/54 |
| 2003/0068225 | A1 | 4/2003 | Housley et al. | |
| 2003/0082051 | A1 | 5/2003 | Bertrand et al. | |
| 2003/0094862 | A1 | 5/2003 | Torrance et al. | |
| 2006/0153683 | A1 | 7/2006 | Dube et al. | |

OTHER PUBLICATIONS

International Preliminary Report on Patentability for International Application No. PCT/US2013/051562 dated Feb. 19, 2015.
European Search Report for EP Application No. 13827417.0 dated Jul. 27, 2015.

* cited by examiner

STATOR ANTI-ROTATION LUG

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

A stator vane assembly is arranged at one or more stages of the compressor section. The stator vane assembly includes a plurality of vanes supported within the compressor case. The vanes are allowed some movement to accommodate thermal growth during operation but are otherwise prevented from moving relative to the compressor case by a plurality of anti-rotation lugs. A fastener is utilized to secure the anti-rotation lugs to the compressor case. Limited space is available about the outer surface of the compressor case and therefore it is desirable to develop fastener structures that require limited space and that can accommodate manufacturing and assembly tolerances.

SUMMARY

A compressor assembly of a gas turbine engine according to an exemplary embodiment of this disclosure, among other possible things includes a case including at least one opening, a stator assembly supported within the case, and a lug assembly securing the stator assembly relative to the case. The lug assembly includes a lug engaging the stator assembly and a boss extending from the lug through the opening in the case. The boss includes a threaded hole receiving a threaded member holding the lug assembly to the case.

In a further embodiment of the foregoing compressor assembly, the lug includes an outer surface and the boss extends transverse to the outer surface with a relief disposed at the interface between the outer surface and the boss.

In a further embodiment of any of the foregoing compressor assemblies, the case includes a thickness and a length of the boss extending from the outer surface of the lug is greater than the case thickness.

In a further embodiment of any of the foregoing compressor assemblies, the boss defines a seat for the threaded member in an assembled condition, the seat spaced apart from an outer surface of the case.

In a further embodiment of any of the foregoing compressor assemblies, the hole extends through the boss and the lug.

In a further embodiment of any of the foregoing compressor assemblies, the case includes a pad through which the opening for the boss is defined, the pad defining a substantially flat surface.

In a further embodiment of any of the foregoing compressor assemblies, the case includes first and second opposing flanges and an outer surface that tapers in a direction away from each of the first and second flanges toward the pad.

An anti-rotation lug assembly according to an exemplary embodiment of this disclosure, among other possible things includes a lug engageable for movable structure maintaining a radial position, a boss extending from the lug including a threaded hole, and a threaded member receivable within the threaded hole for holding the lug assembly to a support structure.

In a further embodiment of the foregoing anti-rotation lug assembly, the lug includes an outer surface and the boss extends transverse to the outer surface with a relief disposed at the interface between the outer surface and the boss.

In a further embodiment of any of the foregoing anti-rotation lug assemblies, the boss defines a seat for the threaded member spaced apart from a surface of a support structure.

In a further embodiment of any of the foregoing anti-rotation lug assemblies, the threaded hole extends through the boss and the lug.

A gas turbine engine according to an exemplary embodiment of this disclosure, among other possible things includes a fan including a plurality of fan blades rotatable about an axis. A compressor section includes a case with at least one opening, a stator assembly supported within the case, and a lug assembly securing the stator assembly relative to the case. The lug assembly includes a lug engaging the stator assembly and a boss extending from the lug through the opening in the case. The boss includes a threaded hole receiving a threaded member holding the lug assembly to the case, a combustor in fluid communication with the compressor section, a turbine section in fluid communication with the combustor and for driving the compressor section.

In a further embodiment of the foregoing gas turbine engine, the lug includes an outer surface and the boss extends transverse to the outer surface with a relief disposed at the interface between the outer surface and the boss.

In a further embodiment of any of the foregoing gas turbine engines, the case includes a thickness and a length of the boss extending from the outer surface of the lug is greater than the case thickness.

In a further embodiment of any of the foregoing gas turbine engines, the boss defines a seat for the threaded member in an assembled condition, the seat spaced apart from an outer surface of the case.

In a further embodiment of any of the foregoing gas turbine engines, the case includes first and second opposing flanges and an outer surface that tapers in a direction away from each of the first and second flanges toward a pad.

In a further embodiment of any of the foregoing gas turbine engines, includes a geared architecture driven by the turbine section for rotating the fan about the axis.

A method of supporting a stator vane according to an exemplary embodiment of this disclosure, among other possible things includes supporting at least one stator vane, engaging a lug to the stator vane to maintain a position relative to the case, extending a boss of the lug through the case, and securing a threaded fastener within a threaded hole defined through the boss.

In a further embodiment of the foregoing method, the boss defines a seat spaced apart from an outer surface of the case and including securing the fastener against the seat and spaced apart from the outer surface of the case.

In a further embodiment of any of the the foregoing methods, an interface between the boss and the lug includes a relief that provides a clearance such that a surface of the lug fits against an inner surface of the case.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
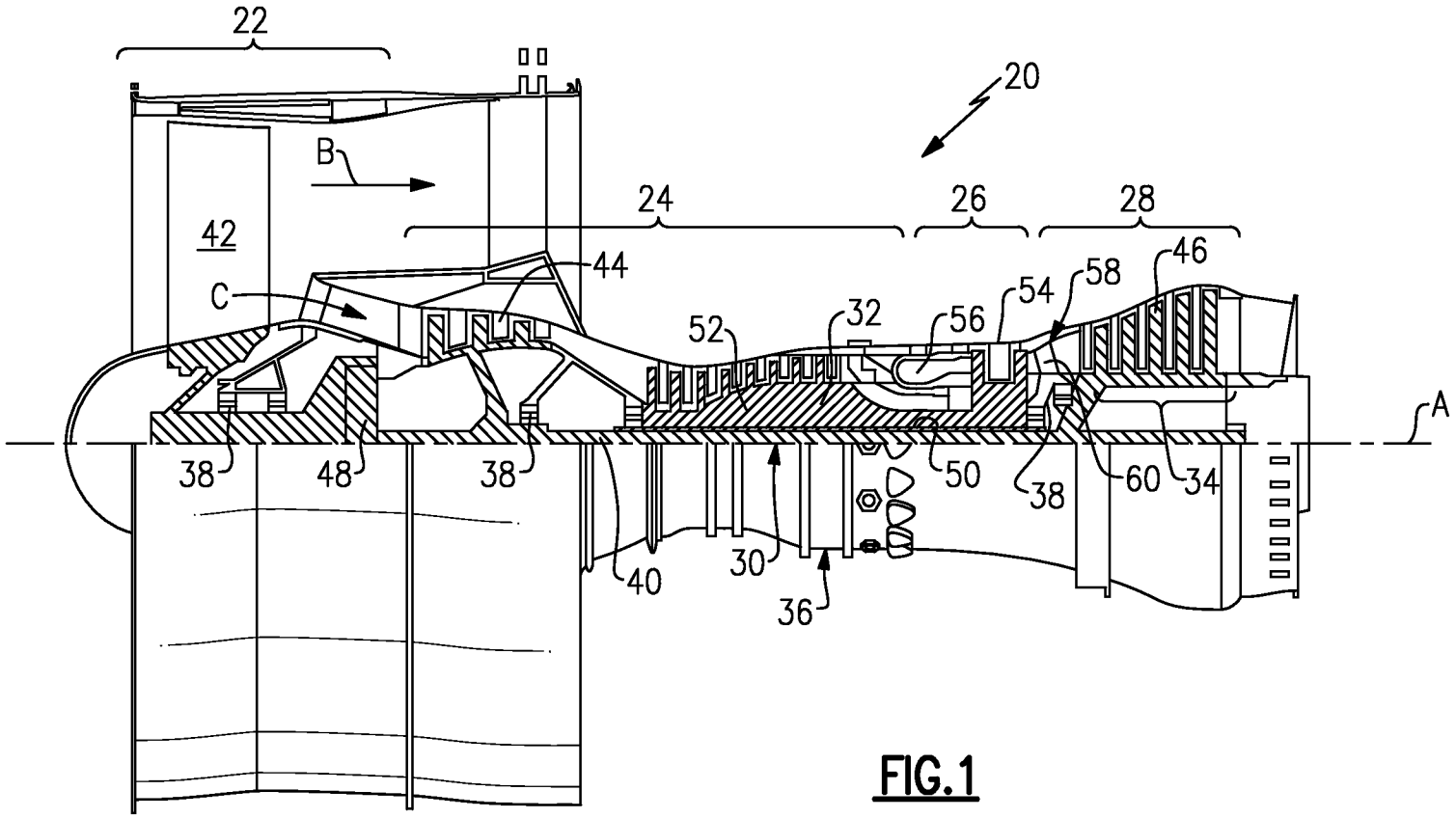
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise". Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram} \circ \text{R})/518.7)^{0.5}]$. The "Low corrected fan tip speed", as disclosed herein according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
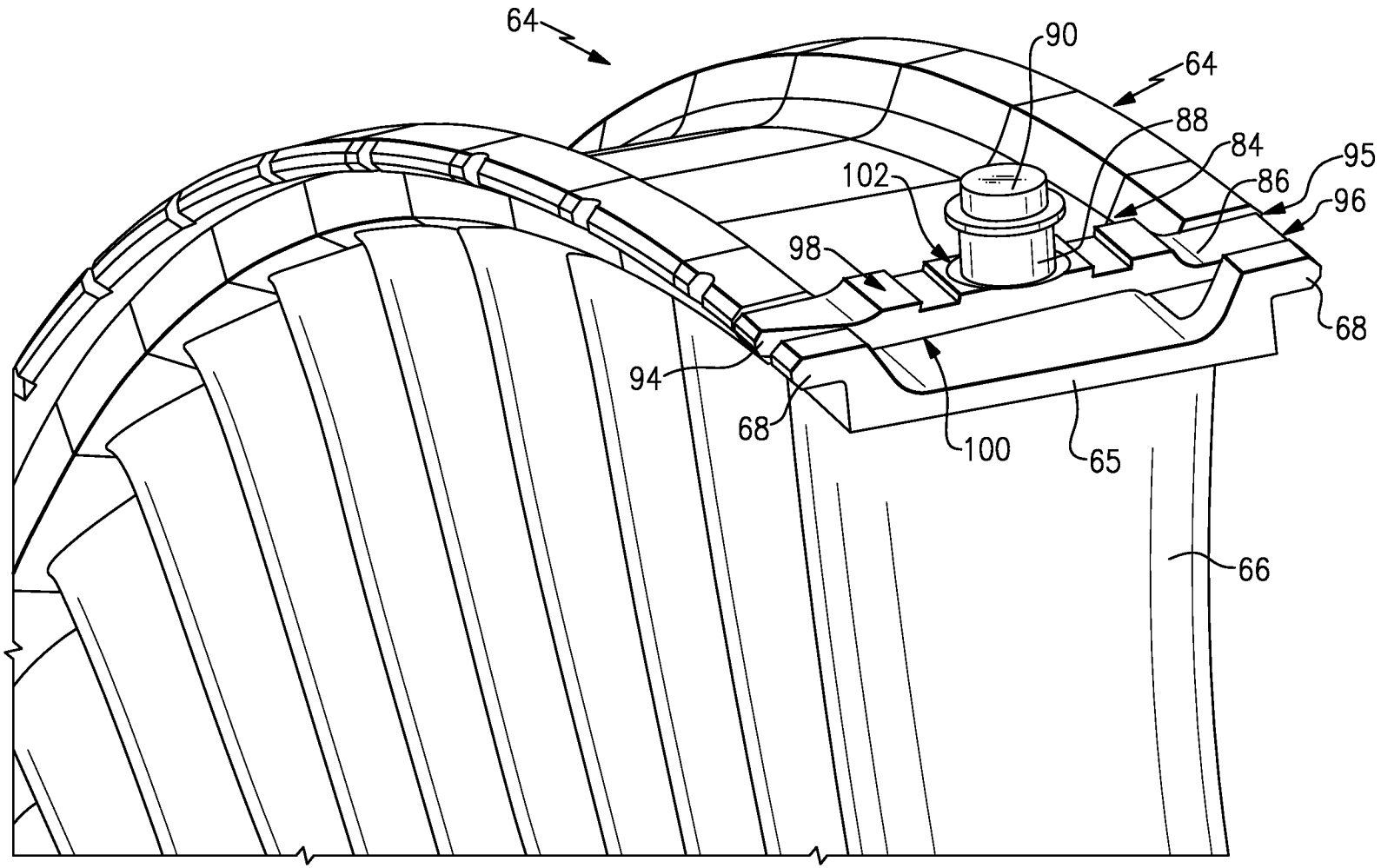
FIG. 2 is a schematic view of an example anti-rotation lug.
Figure 3:
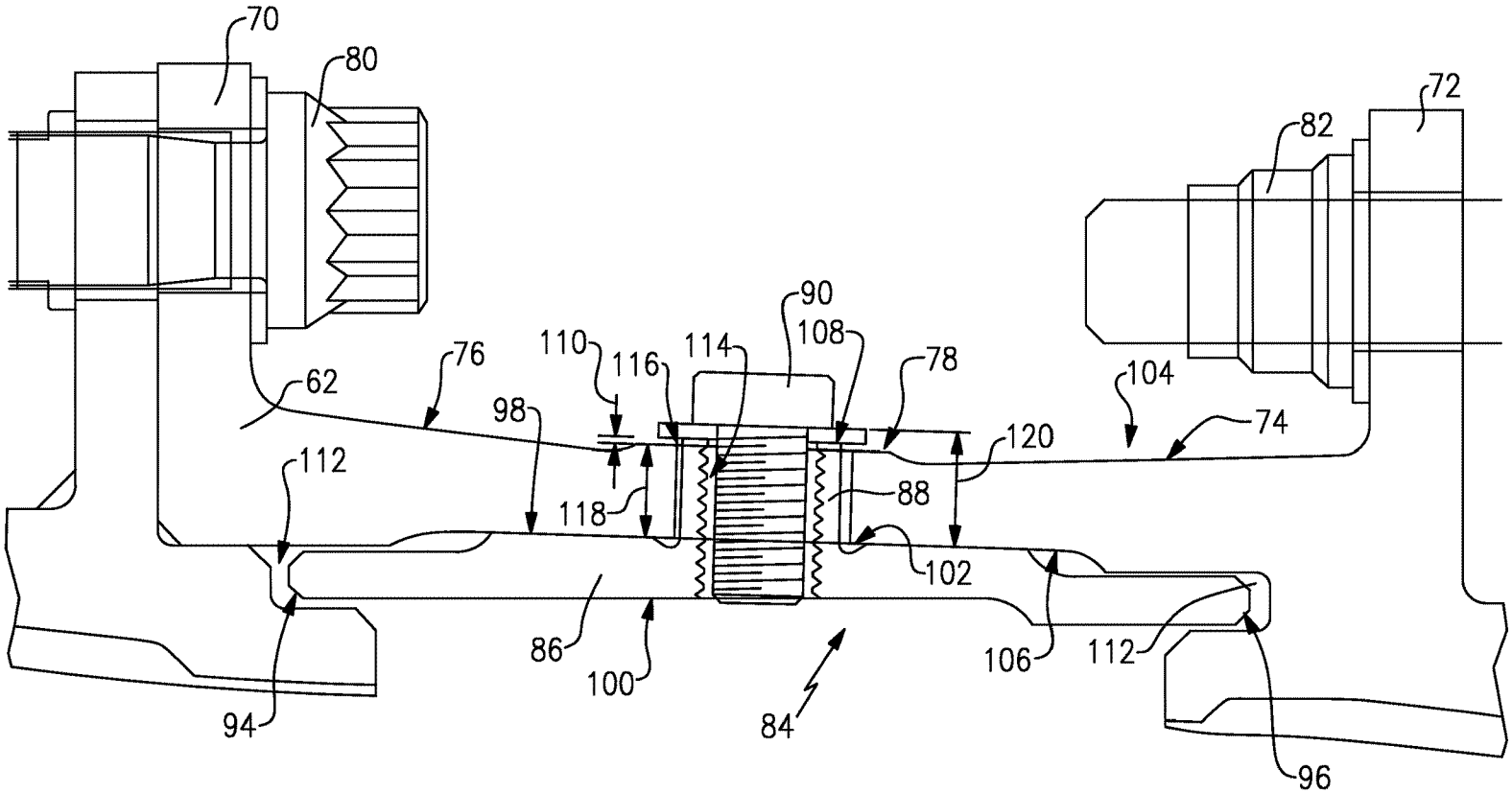
FIG. 3 is a cross-section view of an example anti-rotation lug.

Referring to FIGS. 2 and 3, with continued reference to FIG. 1, the compressor section 24 includes a compressor case 62 that supports a stator assembly 64. The stator assembly 64 is disposed within compressor stages and is fixed relative to the rotating blades disposed on either side of stator fixed vanes 66. The example stator vanes 66 include vane feet 68. The vane feet 68 are received within channels 112 defined within the compressor case 62.

The compressor case 62 includes an outer surface 104 that is disposed between a first flange 70 and a second flange 72. The outer surface 104 comprises a first tapered portion 74 and a second tapered portion 76. The tapered portions 74, 76 taper in a direction away from the corresponding first and second flanges 70, 72 towards a central pad 78. The central pad 78 defines a thickness 118.

The stator assembly 64 is held within the channels 112 defined within the compressor case 62. An anti-rotation lug assembly 84 is disposed between at least one of the various vanes 66 to hold a circumferential position of the stator assembly 64 within the compressor case 62.

The example lug assembly 84 includes a lug 86 and a boss 88 that extends from the lug 86. The lug 86 includes a radially outer surface 98 and a radially inner surface 100. The boss 88 extends transversely upward from the radially outward surface 98 through an opening 116 through the compressor case 62. In this example, the opening 116 extends through the pad portion 78 of the compressor case 62. As appreciated, the central pad 78 provides a flat surface between the two tapered portions 74 and 76.

The example lug assembly 84 is engaged with the stator assembly 64 and specifically at least one of the vanes 66 to hold the vane in a desired circumferential position.

The example lug 84 includes the boss 88 that extends through the opening 116. The boss 88 defines a seat 108 for a threaded fastener 90. The example threaded fastener 90 is a threaded screw that is threadingly received within a threaded hole 114 defined through the boss 88 and the lug 86. The boss 88 extends from the outer surface 98 a length 120 that is greater than the thickness 118 of the compressor case 62 such that the seat 108 is spaced a distance apart from the central pad 78 to define a gap 110. The gap 110 accommodates assembly and manufacturing tolerances while also accommodating relative thermal expansion of the compressor case 62.

The example lug 86 also includes a relief 102 that is disposed at the interface between the boss 88 and the outer surface 98. The relief 102 provides for the outer surface 98 of the lug 86 to seat against the inner surface 106 of the case 62. The relief 102 eliminates a rounded portion between the boss 88 and lug 86 that in some instances could prevent a desired seating of the lug 86 within the compressor case 62.

Figure 4:
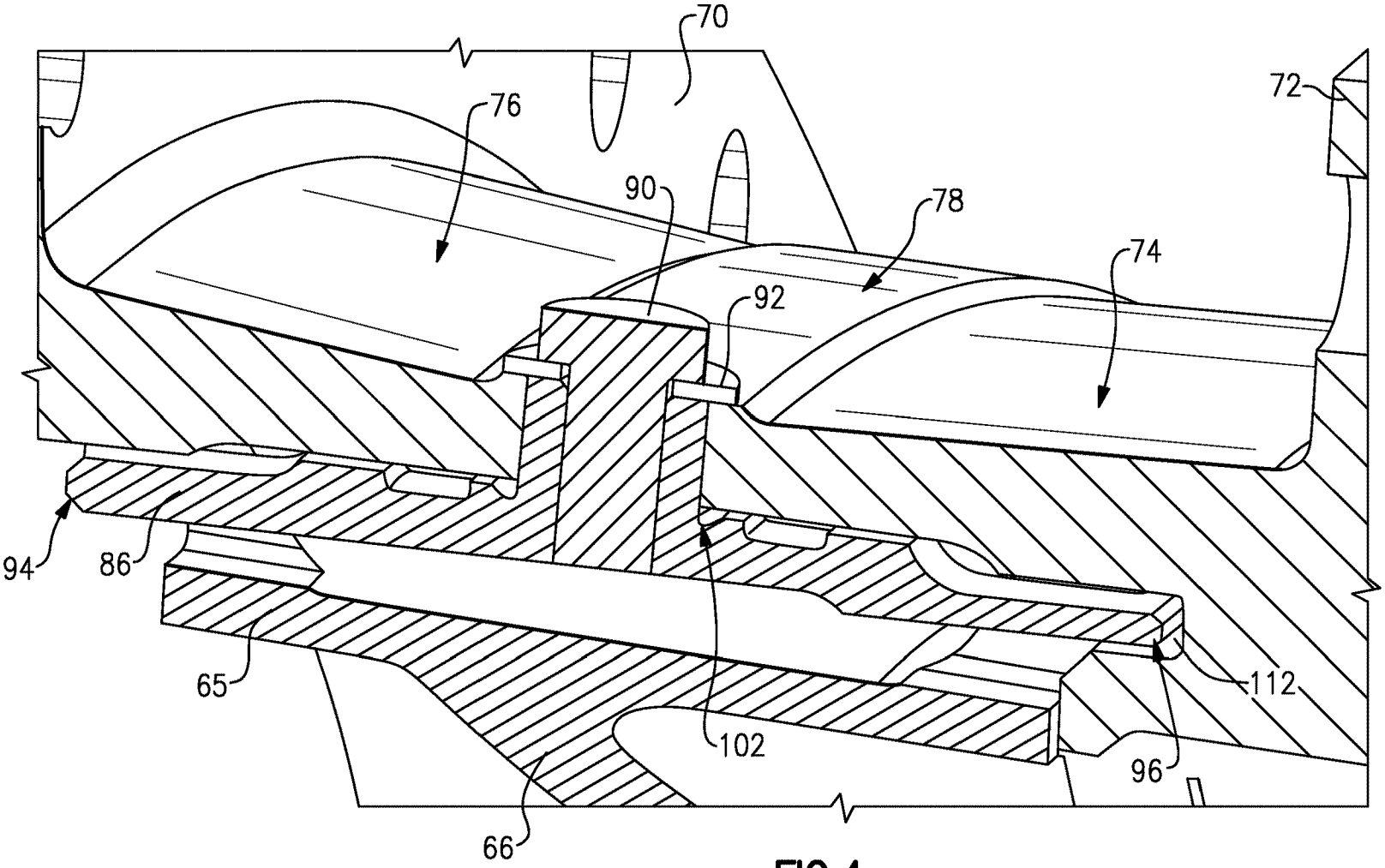
FIG. 4 is a perspective sectional view of the example anti-rotation lug assembly.

Referring to FIG. 4 with continued reference to FIGS. 2 and 3, during assembly operations, the lug assembly 84 is assembled to the case 76. The stator assembly 64 is then placed between the appropriate rotor stages and the case 62. The stator assembly 64 is slid into place and received within the channels 112 defined by case 62 while concurrently engaging ends 94 and 96 of the lug assembly 84 within slots 95 of the vane platform 65.

In this example, a single lug assembly 84 is shown; however, a plurality of lug assemblies 84 would be included about the circumference of the compressor case 62 to maintain a desired circumferential position of the stator assembly 64.

The threaded screw 90 is seated on a washer 92 that is in turn seated on the seat 108 of the boss 88. Seating the threaded member 90 and the washer 92 on the boss 88 and specifically on the seat 108 instead of the compressor case 62 eliminates stresses that can buildup in the fastening member 90 caused by differential thermal expansions between the various components.

Accordingly, the example anti-rotation lug assembly 84 includes features that reduce and eliminate structures that could generate stresses during operation caused by for example, differential thermal expansion. Moreover, the boss 88 provides a reduced height on the outer surface 104 of the compressor case 62 to provide space for tools to engage fasteners 80 and 82 that are utilized to secure the flanges 70 and 72 to other components of the gas turbine engine assembly 20.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A compressor assembly of a gas turbine engine comprising:

a case including at least one opening and axially spaced apart channels;

a stator assembly supported within the case, the stator assembly including a plurality of stator vanes received within the channels of the case and movable circumferentially within the channels; and a lug assembly separate from the plurality of stator vanes for holding a position of the plurality of stator vanes relative to the case, the lug assembly including a lug disposed within the channels and abutting at least one of the plurality of stator vanes, the lug assembly further including a boss extending from the lug through the opening in the case, the boss including a threaded hole receiving a threaded member holding the lug assembly to the case.

2. The compressor assembly as recited in claim 1, wherein the lug includes an outer surface and the boss extends transverse to the outer surface with a relief disposed at an interface between the outer surface and the boss.

3. The compressor assembly as recited in claim 2, wherein the case includes a thickness and a length of the boss extending from the outer surface of the lug is greater than the case thickness.

4. The compressor assembly as recited in claim 3, wherein the boss defines a seat for the threaded member in an assembled condition, the seat spaced apart from an outer surface of the case.

5. The compressor assembly as recited in claim 1, wherein the hole extends through the boss and the lug.

6. The compressor assembly as recited in claim 1, wherein the case includes a pad through which the opening for the boss is defined, the pad defining a substantially flat surface.

7. The compressor assembly as recited in claim 6, wherein the case includes first and second opposing flanges and an outer surface that tapers in a direction away from each of the first and second flanges toward the pad.

8. The compressor assembly as recited in claim 1, wherein each of the plurality of stator vanes includes a platform including feet received in the spaced apart channels and the lug extends between the spaced apart channels.

9. The compressor assembly as recited in claim 8, wherein at least one of the plurality of stator vanes includes a slot in an upper platform and the lug is received within the slot.

10. A gas turbine engine comprising:

a fan including a plurality of fan blades rotatable about an axis;

a compressor section including a case with at least one opening, a stator assembly supported within the case, and a lug assembly securing the stator assembly relative to the case, the lug assembly including a lug extending between axially spaced apart channels in the case and holding the stator assembly in position, the lug assembly further including a boss extending from the lug through the opening in the case, the boss including a threaded hole receiving a threaded member holding the lug assembly to the case;

a combustor in fluid communication with the compressor section;

a turbine section in fluid communication with the combustor and for driving the compressor section.

11. The gas turbine engine as recited in claim 10, wherein the lug includes an outer surface and the boss extends transverse to the outer surface with a relief disposed at an interface between the outer surface and the boss.

12. The gas turbine engine as recited in claim 10, wherein the case includes a thickness and a length of the boss extending from the outer surface of the lug is greater than the case thickness.

13. The gas turbine engine as recited in claim 10, wherein the boss defines a seat for the threaded member in an assembled condition, the seat spaced apart from an outer surface of the case.

14. The gas turbine engine as recited in claim 10, wherein the case includes first and second opposing flanges and an outer surface that tapers in a direction away from each of the first and second flanges toward a pad.

15. The gas turbine engine as recited in claim 10, including a geared architecture driven by the turbine section for rotating the fan about the axis.

16. A method of supporting a stator vane within a case comprising:

supporting at least one stator vane within axially spaced apart channels of a case;

engaging a lug extending across the axially spaced apart channels to at least one of a plurality of stator vanes to maintain a position of the plurality of stator vanes relative to the case;

extending a boss of the lug through the case; and securing a threaded fastener within a threaded hole defined through the boss.

17. The method as recited in claim 16, wherein the boss defines a seat spaced apart from an outer surface of the case and including securing the fastener against the seat and spaced apart from the outer surface of the case.

18. The method as recited in claim 16, wherein an interface between the boss and the lug includes a relief that provides a clearance such that a surface of the lug fits against an inner surface of the case.

* * * * *